US007695885B2

(12) United States Patent
Yasunaga et al.

(10) Patent No.: US 7,695,885 B2
(45) Date of Patent: Apr. 13, 2010

(54) DEVELOPER AND IMAGE FORMING METHOD USING THE DEVELOPER

(75) Inventors: Hideaki Yasunaga, Ibaraki (JP); Minoru Nakamura, Takarazuka (JP); Masayuki Hagi, Minoo (JP); Takuya Kadota, Kobe (JP); Hiroaki Katoh, Nagaokakyo (JP); Yoshihiro Mikuriya, Nishinomiya (JP); Katsunori Kurose, Takarazuka (JP); Atsushi Yamamoto, Kawanishi (JP); Masahide Inoue, Katsuragi (JP)

(73) Assignee: Ricoh Company Limited, Tokyo (JP)

( * ) Notice: Subject to any disclaimer, the term of this patent is extended or adjusted under 35 U.S.C. 154(b) by 540 days.

(21) Appl. No.: 11/624,525

(22) Filed: Jan. 18, 2007

(65) Prior Publication Data

US 2008/0038656 A1 Feb. 14, 2008

(30) Foreign Application Priority Data

Feb. 2, 2006 (JP) ..... 2006-025178

(51) Int. Cl.
*G03G 9/00* (2006.01)

(52) U.S. Cl. ..... 430/111.4; 430/120.1; 430/123.5; 430/123.56

(58) Field of Classification Search ..... 430/111.4, 430/120.1, 123.5, 123.56
See application file for complete search history.

(56) References Cited

U.S. PATENT DOCUMENTS 4,347,298 A * 8/1982 Kroll et al. ..... 430/97
2006/0204882 A1 9/2006 Nozaki et al.
2006/0210902 A1 9/2006 Nakamura et al.
2006/0275686 A1 12/2006 Kadota et al.
2008/0199234 A1 8/2008 Hagi et al.

FOREIGN PATENT DOCUMENTS

| | | |
|---|---|---|
| JP | 9-34159 | 2/1997 |
| JP | 9-34174 | 2/1997 |
| JP | 9-204063 | 8/1997 |
| JP | 11-295923 | 10/1999 |
| JP | 2000-3066 | 1/2000 |
| JP | 2002-278131 | 9/2002 |

(Continued)

OTHER PUBLICATIONS

U.S. Appl. No. 11/924,994, filed Oct. 26, 2007, Katoh, et al.

(Continued)

*Primary Examiner*—Mark A Chapman
(74) *Attorney, Agent, or Firm*—Oblon, Spivak, McClelland, Maier & Neustadt, L.L.P.

(57) ABSTRACT

A negatively-chargeable non-magnetic one-component developer for developing an electrostatic latent image using a contact DC-bias development method, having a capacitance of $1.05\times10^{-12}$ to $1.25\times10^{-12}$ F, a volume resistivity of $5.0\times10^{10}$ to $5.0\times10^{12}$ Ω·cm and a dielectric loss tangent of $1.0\times10^{-3}$ to $2.0\times10^{-2}$. In a contact DC-bias development method, the developer has a capacitance of $1.30\times10^{-12}$ to $1.60\times10^{-12}$ F, a resistivity of $5.0\times10^{9}$ to $5.0\times10^{10}$ Ω·cm and a dielectric loss tangent of $1.0\times10^{-3}$ to $2.0\times10^{-2}$. In a non-contact DC/AC-bias development method, the developer has a capacitance of $1.45\times10^{-12}$ to $1.60\times10^{-12}$ F, a resistivity of $5.0\times10^{9}$ to $1.0\times10^{10}$ Ω·cm and a dielectric loss tangent of $1.0\times10^{-3}$ to $2.0\times10^{-2}$.

20 Claims, 1 Drawing Sheet

FOREIGN PATENT DOCUMENTS

JP 2004-333970 11/2004

OTHER PUBLICATIONS

U.S. Appl. No. 12/048,865, filed Mar. 14, 2008, Yasunaga, et al.
U.S. Appl. No. 11/857,175, filed Sep. 18, 2007, Matsumoto, et al.
U.S. Appl. No. 11/963,279, filed Dec. 21, 2007, Mikuriya, et al.
U.S. Appl. No. 11/965,522, filed Dec. 27, 2007, Fuwa, et al.
U.S. Appl. No. 12/017,853, filed Jan. 22, 2008, Masumoto, et al.
U.S. Appl. No. 12/026,057, filed Feb. 5, 2008, Nozaki, et al.
U.S. Appl. No. 12/035,892, filed Feb. 22, 2008, Kadota, et al.
U.S. Appl. No. 12/046,784, filed Mar. 12, 2008, Nozaki, et al.
U.S. Appl. No. 12/048,689, filed Mar. 14, 2008, Kadota, et al.
U.S. Appl. No. 12/049,719, filed Mar. 17, 2008, Yamamoto, et al.
U.S. Appl. No. 12/050,663, filed Mar. 18, 2008, Izutani, et al.
U.S. Appl. No. 12/050,963, filed Mar. 19, 2008, Ishikawa, et al.
U.S. Appl. No. 12/051,248, filed Mar. 19, 2008, Hagi, et al.
U.S. Appl. No. 11/851,048, filed Sep. 6, 2007, Murakami, et al.
U.S. Appl. No. 11/851,617, filed Sep. 7, 2007, Murakami, et al.
U.S. Appl. No. 11/854,783, filed Sep. 13, 2007, Nakamura, et al.
U.S. Appl. No. 11/855,759, filed Sep. 14, 2007, Katoh, et al.
U.S. Appl. No. 11/856,248, filed Sep. 17, 2007, Murakami, et al.
U.S. Appl. No. 12/010,369, filed Jan. 24, 2008, Yasunaga, et al.
U.S. Appl. No. 11/779,648, filed Jul. 18, 2007, Yamamoto, et al.
U.S. Appl. No. 12/043,633, filed Mar. 6, 2008, Nakamura, et al.
U.S. Appl. No. 12/046,869, filed Mar. 12, 2008, Nozaki, et al.
U.S. Appl. No. 11/855,739, filed Sep. 14, 2007, Fuwa, et al.
U.S. Appl. No. 12/027,704, filed Feb. 7, 2008, Fuwa, et al.

* cited by examiner

DEVELOPER AND IMAGE FORMING METHOD USING THE DEVELOPER

BACKGROUND OF THE INVENTION

1. Field of the Invention

The present invention relates to a developer for developing an electrostatic latent image, and more particularly to a negatively-chargeable non-magnetic one-component developer. The present invention also relates to an image forming method using the developer.

2. Discussion of the Background

Electrophotographic image forming methods typically include the following processes:

(1) charging a surface of a photoreceptor to such that the surface has a predetermined potential (charging process);

(2) irradiating the charged surface of the photoreceptor with light to form an electrostatic latent image on the surface of the photoreceptor (light irradiating process);

(3) developing the electrostatic latent image with a developer including a colored toner to form a toner image on the surface of the photoreceptor (developing device);

(4) transferring the toner image onto a receiving material optionally via an intermediate transfer medium (transfer process); and (5) fixing the toner image on the receiving material by applying heat, etc. thereto, resulting in formation of a copy (fixing process).

Dry developing methods used for electrophotography and electrostatic recording methods are broadly classified into two-component developing methods using a two-component developer including a toner and a carrier and one component developing methods using a one-component developer including a toner and no carrier.

The two-component developing methods have an advantage in that toner images having good image qualities can be relatively stably produced but have a drawback in that the carrier deteriorates and in addition the ratio of the toner and the carrier in the developer varies and thereby image qualities tend to vary when the developer is used for a long period of time. In addition, it is troublesome to keep the developing devices maintained and it is hard to miniaturize the developing devices. Therefore, the one-component developing methods using a one-component developer (hereinafter referred to as a one-component toner) attract attention now.

In the one-component developing methods, a developer (i.e., toner) is typically fed by at least one toner feeding member and the fed toner develops an electrostatic latent image formed on an image bearing member, resulting in formation of a visual (toner) image. In addition, a toner thickness controlling member is arranged so as to face the toner feeding member to form a toner layer having an even thickness on the toner feeding member and to frictionally charge the toner particles in the toner layer. Blades are typically used as the toner thickness controlling member. Specifically, toner particles located on and fed by the toner feeding member are pressed by a blade serving as the toner thickness controlling member, and thereby a toner layer having a predetermined thickness can be formed on the toner feeding member while being frictionally charged by the blade. Rollers can be used as the toner thickness controlling member instead of blades.

The charging methods are broadly classified into non-contact charging methods such as wire charging methods which utilize corona discharging, and contact charging methods utilizing charge injection or short-range charging methods utilizing small gap discharging. Recently, contact charging methods are typically used to miniaturize the charging device and reduce the amount of generated oxidizing materials (such as ozone and NOx).

In the developing process, the bottom portion of the toner layer on the toner feeding member (such as developing sleeves), i.e., the bottom portion of the toner layer near the surface of the sleeve, has a large amount of charge, and thereby the bottom portion is strongly attracted by the surface of the sleeve due to reflection power. Therefore, the bottom portion is hardly moved on the surface of the sleeve, and the toner particles in the bottom portion of the toner layer on the sleeve is hardly transferred to an electrostatic latent image. This phenomenon is called "a charge-up phenomenon". This charge-up phenomenon easily occurs under low humidity conditions.

When the charge-up phenomenon occurs, the upper portion of the toner layer on the sleeve has a small amount of charge, and thereby problems such as a background development problem in that the background area of an image is soiled with toner particles, a toner leaking problem in that toner particles leak from the developing device, and a toner scattering problem in that toner particles are scattered around the developing device are caused. In order to prevent occurrence of such problems, it is preferable to uniformly charge the toner particles in the toner layer. In attempting to prevent occurrence of such problems, the following proposals for improving electric properties of toner have been made.

Specifically, published unexamined Japanese patent application No. (hereinafter referred to as JP-A) 09-34159 discloses a toner having a specific dielectric loss tangent and includes a carbon black having a specific average particle diameter in a predetermined amount. One-component toners are required to have a charge property so as to be rapidly charged to have and maintain a predetermined amount of charge. Therefore, the capacity, and resistance of a toner have to be also controlled so as to fall in proper ranges as well as dielectric loss tangent. In other words, good charge properties cannot be imparted to a one-component developer (i.e., toner) only by controlling the dielectric loss tangent of the toner.

JP-A 09-34174 discloses a toner including an acidic carbon black having a pH of not higher than 7. Since acidic carbon blacks have poor dispersibility in resins, the resultant toner tends to have a high dielectric loss tangent, and therefore the toner cannot stably maintain a charge.

JP-A 2004-333970 discloses a toner having a high dielectric loss tangent. Therefore, the toner has poor charging ability, and thereby a problem in that the toner has a small amount of charge occurs. In addition, the materials constituting the toner are poorly dispersed in the toner.

JP-A 09-204063 discloses a toner in which a wax is dispersed well. However, the capacitance, resistivity and dielectric loss tangent of the toner, by which the charging ability of the toner can be represented, are not specified. Therefore, a one-component developer (i.e., toner) having good charging ability cannot be provided. Since the dispersion state of the constitutional materials in the toner and the charging ability of the toner change depending on the dielectric loss tangent of the toner, it is important to specify the absolute value of the dielectric loss tangent of the toner.

JP-A 11-295923 discloses a toner having a specific dielectric loss tangent at 100 Hz. As a result of the present inventors' study, such a toner cannot satisfy a requirement for one component developers such that the charge of the toner has to be rapidly increased to a desired charge quantity and the charge quantity is maintained. In addition, the dielectric loss tangent described in the specification of JP-A 11-295923 is too small to be balanced with the resistivity and capacitance of the toner, and thereby the toner is defectively charged.

JP-A 2000-3066 discloses a toner having a relatively high dielectric constant. Thereby, the toner has a relatively low dielectric loss tangent. In this case, the toner has a large amount of charge and a low charge rising property.

Because of these reasons, a need exists for a one component toner which can be efficiently charged frictionally at a nip between a developer feeding member and a toner layer thickness controlling blade and which can produce high quality images.

SUMMARY OF THE INVENTION

As an aspect of the present invention, a negatively-chargeable non-magnetic one-component developer (toner) is provided which has a capacitance of from $1.05\times10^{-12}$ to $1.25\times10^{-12}$ F, a resistivity of from $5.0\times10^{10}$ to $5.0\times10^{12}$ Ω·cm and a dielectric loss tangent of from $1.0\times10^{-3}$ to $2.0\times10^{-2}$. These properties are measured by applying an AC voltage having a voltage of 0.1 V and a frequency of $1.0\times10^{3}$ Hz to the developer (i.e., toner) while the toner is considered to be an RC parallel equivalent circuit. This toner is preferably used for an image forming method including forming an electrostatic latent image on an image bearing member; developing the electrostatic latent image with the one-component developer to form a toner image on the image bearing member using a contact DC-bias development method (in which a DC voltage is applied as a development bias); transferring the toner image onto a receiving material optionally via an intermediate transfer medium; and fixing the toner image on the receiving material.

When the toner is used for a contact AC-bias development method (in which an AC voltage is applied as a development bias), the toner has a capacitance of from $1.30\times10^{-12}$ to $1.60\times10^{-12}$ F, a resistivity of from $5.0\times10^{9}$ to $5.0\times10^{10}$ Ω·cm and a dielectric loss tangent of from $1.0\times10^{-3}$ to $2.0\times10^{-2}$.

When the toner is used for a non-contact DC/AC-bias development method (in which a DC voltage overlapped with an AC voltage is applied as a development bias), the toner has a capacitance of from $1.45\times10^{-12}$ to $1.60\times10^{-12}$ F, a resistivity of from $5.0\times10^{9}$ to $1.0\times10^{10}$ Ω·cm and a dielectric loss tangent of from $1.0\times10^{-3}$ to $2.0\times10^{-2}$.

The toner preferably has a volume average particle diameter of from 6 to 10 μm and a circularity of from 0.900 to 0.930.

As another aspect of the present invention, an image forming method is provided which includes forming an electrostatic latent image on an image bearing member; developing the electrostatic latent image with a one-component developer using a contact DC-bias development method, a contact AC-bias development method or a non-contact DC/AC-bias development method, to form a toner image on the image bearing member; transferring the toner image onto a receiving material optionally via an intermediate transfer medium; and fixing the toner image on the receiving material, wherein the toner has the above-mentioned specific capacitance, resistivity and dielectric loss tangent.

These and other objects, features and advantages of the present invention will become apparent upon consideration of the following description of the preferred embodiments of the present invention taken in conjunction with the accompanying drawings.

DETAILED DESCRIPTION OF THE INVENTION

Figure 1:
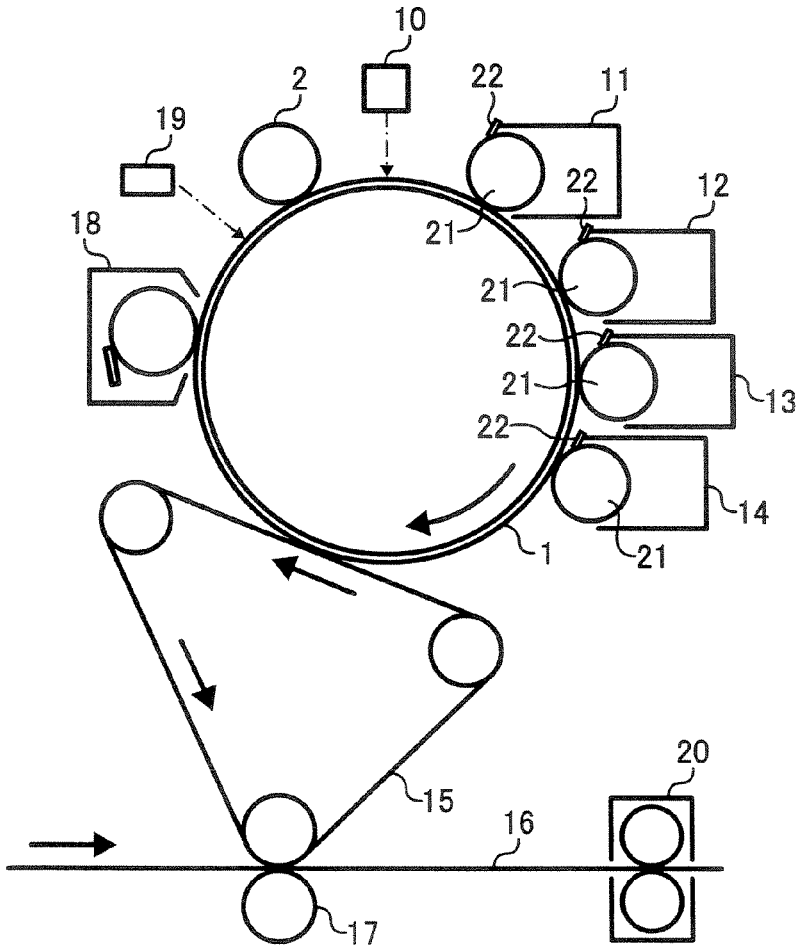
FIG. 1 is a schematic view illustrating an image forming apparatus using the image forming method of the present invention.

The toner of the present invention has a capacitance of from $1.05\times10^{-12}$ to $1.25\times10^{-12}$ F, a resistivity of from $5.0\times10^{10}$ to $5.0\times10^{12}$ Ω·cm and a dielectric loss tangent of from $1.0\times10^{-3}$ to $2.0\times10^{-2}$ when used for a contact DC-bias development method. When used for a contact AC-bias development method, the toner has a capacitance of from $1.30\times10^{-12}$ to $1.60\times10^{-12}$ F, a resistivity of from $5.0\times10^{9}$ to $5.0\times10^{10}$ Ω·cm and a dielectric loss tangent of from $1.0\times10^{-3}$ to $2.0\times10^{-2}$. In addition, when the toner is used for a non-contact DC/AC-bias development method, the toner has a capacitance of from $1.45\times10^{-12}$ to $1.60\times10^{-12}$ F, a resistivity of from $5.0\times10^{9}$ to $1.0\times10^{10}$ Ω·cm and a dielectric loss tangent of from $1.0\times10^{-3}$ to $2.0\times10^{-2}$. The capacitance, resistivity and dielectric loss tangent are measured while the toner is considered to be an RC parallel equivalent circuit. Measurements are performed under the following conditions:

(1) Measurement cell: Liquid-use cell 12964 from Toyo Corporation;

(2) Weight of sample: 3.0 g;

(3) Applied voltage: AC voltage having a voltage of 0.1 V and a frequency of $1.0\times10^{3}$ Hz; and (4) Pressure applied to sample: 7.5N.

When the capacitance is too low, the toner has too low a saturation charge quantity, and thereby a background development problem in that the background area of an image is soiled with toner particles is caused. In contrast, when the capacitance is too high, the toner has too high a saturation charge quantity. In this case, the toner has poor developing ability and therefore images with low image density are formed.

When the resistivity is too low, charges formed in toner particles easily escape therefrom particularly under high humidity conditions. When the resistivity is too high, there is no critical problem. However, in view of the resistivity of binder resins, which have the highest resistivity among the toner constituents under a frequency condition of $1\times10^{3}$ Hz, the upper limit is set to $5.0\times10^{12}$ Ω·cm.

When the dielectric loss tangent is too low, the dielectric loss tangent is not balanced with the resistivity and capacitance of the toner, and thereby the toner is defectively charged. Therefore, the upper limit is set to $1.0\times10^{3}$. When the dielectric loss tangent is too high, the charge rising property of the toner deteriorates to an extent such that the toner cannot be used for one-component developing method.

When the toner satisfies one of the above-mentioned conditions, the toner can be quickly charged to the desired charge quantity level (i.e., the charge quantity level suitable for one-component developing methods) when passing through the nip between a toner layer thickness controlling member and a developer feeding member (i.e., a developing sleeve).

The surface of the toner of the present invention is preferably treated with one or more particulate inorganic materials (i.e., external additives) as long as the toner satisfies the above-mentioned conditions. Particularly, when a particulate inorganic material, which strongly adheres to the surface of toner particles, is used, the inorganic material preferably has electric properties (i.e., capacitance, resistivity and dielectric loss tangent) similar to those of the toner. In general, particulate inorganic materials having a primary particle diameter of from 1 to 25 nm tend to strongly adhere to the surface of toner particles.

The added amount of such a particulate inorganic material is from 1 to 5 parts by weight, and preferably from 1.5 to 3.5 parts by weight, based on 100 parts by weight of toner particles to which the particulate inorganic material is to be added. When the added amount is too small, the fluidity, transferability and high temperature resistance of the toner cannot be fully improved. In contrast, when the added amount is too large, the background development problem tends to be caused, and the developing property of the toner and the releasability thereof from fixing members cannot be fully improved.

Particles of the toner of the present invention include a colorant, a binder resin and an additive. The toner particles can be prepared by any one of the following methods:

(1) Pulverization methods including melting and mixing a binder resin, a colorant, a charge controlling agent and a release agent to prepare a toner composition mixture; and pulverizing the toner composition mixture, followed by classification.

(2) Suspension polymerization methods including dissolving or dispersing a colorant, a charge controlling agent and a release agent in a monomer (which is a raw material of a binder resin) to prepare a toner composition mixture; dispersing the toner composition mixture, to which a polymerization initiator is added, in an aqueous dispersion medium including a dispersion stabilizer; heating the mixture to perform suspension polymerization; and subjecting the polymerization product to filtration, washing and drying.

(3) Emulsion aggregation methods including preparing a binder resin emulsion having a polar group; adding a colorant and a charge controlling agent to the emulsion to aggregate the primary particles of the binder resin (i.e., to prepare secondary particles of the binder resin); agitating and heating the aggregates of the binder resin to a temperature higher than the glass transition temperature of the binder resin to adhere the primary particles to each other in the secondary particles; and then subjecting the secondary particles to filtration and drying.

(4) Phase change emulsion methods including dissolving or dispersing a binder resin having a hydrophilic group, a colorant, etc., in an organic solvent; neutralizing the binder resin to perform phase change; and then drying the resultant emulsion.

A pulverization toner, which is prepared by a pulverization method and is an example of the toner of the present invention, will be explained in detail, but the toner of the present invention is not limited thereto.

(Binder Resin)

The binder resin included in the toner is not particularly limited, and any known binder resins which can be used for conventional full color toners can be used. Specific examples thereof include polyester resins, (meth)acrylic resins, styrene-(meth)acrylic copolymers, epoxy resins, cyclic olefin resins (e.g., TOPAS-COC (from Ticona)), etc. Among these resins, polyester resins are preferably used because of having good resistance to stresses applied to the toner in a developing device.

Suitable polyester resins for use in the toner of the present invention include polyester resins which are prepared by subjecting a polyhydric alcohol and a polycarboxylic acid to a polycondensation reaction. Specific examples of dihydric alcohols for use as the polyhydric alcohol include alkylene oxide adducts of bisphenol A such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, and polyoxypropylene(2,0)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polytetramethylene glycol, bisphenol A, hydrogenated bisphenol A, etc. Specific examples of tri- or more hydric alcohols include sorbitol, 1,2,3,6-hexanetetrol, 1,4-sorbitane, pentaerychritol, dipentaerythritol, tripentaerythritol, 1,2,4-butanetriol, 1,2,5-pentanetriol, glycerol, 2-methylpropane triol, 2-methyl1,2,4-butanetriol, trimethylol ethane, trimethylol propane, 1,3,5-trihydroxymethyl benzene, ere.

Specific examples of dicarboxylic acids for use as the polycarboxylic acid include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, iso-dodecenylsuccinic acid, n-octenylsuccinic acid, iso-octenylsuccinic acid, n-octylsuccinic acid, iso-octylsuccinic acid, anhydrides or low alkyl esters of these acids, etc.

Specific examples of tri- or more carboxylic acids for use as the polycarboxylic acid include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarbcxylic acid, 1,3-dicarboxy-2-methyl-2-methylenecarboxypropane, 1,2,4-cyclohexanetricarboxylic acid, tetra(methylenecarboxy)methane, 1,2,7,8-octanetetracarboxylic acid, pyromellitic acid, trimer acids of embole, anhydrides or low alkyl esters of these acids, etc.

In addition, vinyl-polyester resins which are prepared by mixing monomers of a polyester resin, one or more monomers of a vinyl resin, and one or more monomers which are reactive with both the monomers of the polyester resin and the monomers of the vinyl resin, and subjecting the monomers to a polycondensation reaction (to prepare the polyester resin) and a radical reaction (to prepare the vinyl resin) at the same time can also be used as the polyester resin. The monomers which are reactive with both the monomers of the polyester resin and the monomers of the vinyl resin are monomers which can be used for both a polycondensation reaction and a radical reaction, i.e., monomers which have both a carboxyl group which can cause a polycondensation reaction and a vinyl group which can cause a radical reaction. Specific examples of such monomers include fumaric acid, maleic acid, acrylic acid, methacrylic acid, etc.

Specific examples of the monomers for use in preparing the polyester component of the vinyl-polyester resins include the polyhydric alcohols and polycarboxylic acids mentioned above. Specific examples of the monomers for use in preparing the vinyl resin component of the vinyl-polyester resins include styrene and derivatives thereof such as styrene, o-methylstyrene, m-methylstyrene, p-methylstyrene, α-methyl-styrene, p-ethylstyrene, 2,4-dimethylstyrene, p-tert-butylstyrene, and p-chlorostyrene; ethylene-type unsaturated monoolefins such as ethylene, propylene, butylene, and isobutylene; alkyl esters of methacrylic acid such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, and dodecyl methacrylate; alkyl esters of acrylic acid such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, and dodecyl acrylate; unsaturated carboxylic acids such as acrylic acid, methacrylic acid, itaconic acid, and maleic acid; acrylonitrile, esters of maleic acid, esters of itaconic acid, vinyl chloride, vinyl acetate, vinyl benzoate, vinyl methyl ketone, vinyl ethyl ketone, vinyl hexyl ketone, vinyl methyl ether, vinyl ethyl ether, and vinyl isobutyl ether.

Specific examples of the polymerization initiators for use in polymerizing the vinyl monomers include azo-type or diazo-type initiators such as 2,2'-azobis(2,4-dimethylvaleronitrile), 2,2'-azobisisobutylonitirile, 1,1'-azobis(cyclohexane-1-carbonitrile), and 2,2'-azobis-4-methoxy-2,4-dimethylvaleronitrile; and peroxide-type initiators such as benzoyl peroxide, dicumyl peroxide, methyl ethyl ketone peroxide, isopropyl peroxy carbonate, and lauroyl peroxide.

The above-mentioned polyester resins are preferably used as the binder resin of the toner of the present invention. In order that the toner can be used for oil-less fixing methods, the toner preferably has a good combination of releasability and offset resistance. In order to impart a good combination of releasability and offset resistance to the toner, a combination of a first binder resin and a second binder resin is used for the binder resin. Suitable resins for use as the first binder resin include polyester resins which are prepared by subjecting a polyhydric alcohol and a polycarboxylic acid to a polycondensation reaction, and preferably polyester resins which are prepared by subjecting an alkylene oxide adduct of bisphenol A (a polyhydric alcohol) and terephthalic acid or fumaric acid (a polycarboxylic acid) to a polycondensation reaction. Suitable resins for use as the second binder resin include vinyl-polyester resins, and preferably vinyl-polyester resins which are prepared by using an alkylene oxide adduct of bisphenol A, terephthalic acid, trimellitic acid and succinic acid as monomers for forming a polyester resin component; styrene and butyl acrylate as monomers for forming a vinyl resin component; and fumaric acid as a monomer for use in both the polycondensation reaction and radical polymerization reaction.

When the first binder resin is synthesized, it is preferable to internally add a hydrocarbon wax to the resin A hydrocarbon wax can be internally added to the first binder resin by polymerizing a mixture of monomers for constituting the first binder resin with the hydrocarbon wax. Specifically, a mixture of an acid monomer, an alcoholic monomer and a hydrocarbon wax is subjected to a polycondensation reaction. When the first binder resin is a vinyl-polyester resin, the following method is preferably used:

(1) a mixture of monomers for constituting a polyester resin component with a hydrocarbon wax is heated while agitated to perform a polycondensation reaction; and (2) one or more monomers for constituting a vinyl resin component are dropped into the mixture to perform a radical polymerization reaction.

The weight ratio (b1/b2) of the first binder resin (b1) (including a wax) to the second binder resin (b2) is preferably from 20/80 to 45/55, and more preferably from 30/70 to 40/60. When the content of the first binder resin is too low, the releasability and hot offset resistance of the toner deteriorate. In contrast, when the content is too high, the glossiness of images and high temperature preservability of the toner deteriorate.

The binder resin of the toner of the present invention, which preferably includes a first binder resin (including a wax) and a second binder resin, preferably has a softening point of from 100 to 125° C., and more preferably from 105 to 125° C.

The first binder resin including a wax preferably has an acid value of from 5 to 50 mgKOH/g, and more preferably from 10 to 40 mgKOH/g. The second binder resin preferably has an acid value of from 0 to 10 mgKOH/g, and more preferably from 1 to 5 mgKOH/g. Particularly, when polyester resins having such an acid value are used, a colorant can be well dispersed in toner particles and in addition the resultant toner has a sufficient amount of charge. The first binder resin preferably includes a component insoluble to tetrahydrofuran (THF) to impart good hot offset resistance to the toner. The first binder resin including a wax preferably includes THF-insoluble components in an amount of from 0.1 to 15% by weight, preferably from 0.2 to 10% by weight, and more preferably from 0.3 to 5% by weight. (Wax)

In general, waxes having a low polarity have good releasability from fixing members (such as fixing rollers). Therefore, hydrocarbon waxes, which have a low polarity, are preferably used for the toner of the present invention. Hydrocarbon waxes mean waxes constituted of carbon atoms and hydrogen atoms, which do not include a group such as ester groups, alcoholic groups and amide groups. Specific examples of the hydrocarbon waxes include polyolefin waxes such as poly ethylene, polypropylene, and ethylene-propylene copolymers; petroleum waxes such as paraffin waxes and microcrystalline waxes; synthetic waxes such as Fischer Tropsch waxes; etc. Among these hydrocarbon waxes, polyethylene waxes, paraffin waxes, and Fischer Tropsch waxes are preferably used, and polyethylene waxes and paraffin waxes are more preferably used.

The wax used for the toner of the present invention preferably has a melting point of from 70 to 90° C., which is determined as the endothermic peak in differential scanning calorimetry (DSC) observed when the temperature is raised. When the melting point is too high, the wax is insufficiently melted at the fixing process and thereby the toner cannot have good releasability. When the melting point is too low, a preservation problem in that particles of the toner aggregate under high temperature and high humidity conditions is caused. The melting point is more preferably from 70 to 85° C. and even more preferably from 70 to 80° C. such that toner images can be fixed with a good margin even under low temperature conditions.

The half width of the endothermic peak of the wax observed in differential scanning calorimetry is preferably not greater than 7° C. When the endothermic peak of the wax is broad, the high temperature preservability of the toner deteriorates because the wax melts at a relatively low temperature.

The wax is included in the toner in an amount of from 3 to 10% by weight, preferably from 4 to 8% by weight, and more preferably from 4 to 6.5% by weight, based on the total weight of the toner. When the wax content is too low, the amount of the wax exuding from the toner particle is small, and thereby the adhesion between the melted toner image and a fixing member cannot be decreased, resulting in occurrence of a problem in that the toner image is not released from the fixing member, resulting in jamming of the copy sheet. In contrast, when the wax content is too high, the amount of the wax present on the surface of toner particles increases, and thereby the fluidity of the toner deteriorates. Therefore, transferability of the toner from a developing member to a photoreceptor or from a photoreceptor to a receiving material deteriorates, resulting in deterioration of image qualities. Further, the wax present on the surface of toner particles releases therefrom and contaminates developing members and a photoreceptor. Therefore, it is not preferable.

(Colorant)

Known pigments and dyes for use in conventional color toners can be used as the colorant of the toner of the present invention. Specific examples of the pigments and dyes include carbon black, Aniline Blue, chalco-oil blue, chrome yellow, ultramarine blue, DUPONT OIL RED, Ouinoline Yellow, Methylene Blue chloride, Copper Phthalocyanine, Malachite Green oxalate, lamp black, Rose Bengale, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Pigment Yellow 74, C.I. Solvent Yellow 162, C.I. Pigment Yellow 180, C.I. Pigment Yellow 185, C.I. Pigment Blue 15:1, C.I. Pigment Blue 15:3, etc.

The content of the colorant in the toner is preferably 2 to 15 parts by weight based on 100 parts by weight of the total weight of the binder resin. The colorant is preferably used as a master batch which is prepared by dispersing a pigment in a mixture of the first binder resin and the second, binder resin. The content of a colorant in a master batch is preferably from 20 to 40% by weight based on the total weight of the master batch. The added amount of the master batch is preferably controlled such that the content of the colorant in the toner falls in the above-mentioned range.

(Charge Controlling Agent)

Known charge controlling agents for use in conventional toners can be used for the toner of the present invention.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON® 03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

Among these materials, materials which can impart negative charges to the toner are preferably used.

The content of the charge controlling agent in the toner of the present invention is determined depending on the variables such as choice of binder resin, presence of additives, and dispersion method. In general, the content, of the charge controlling agent is preferably from 0.1 to 10 parts by weight, and more preferably from 0.2 to 5 parts by weight, per 100 parts by weight of the binder resin included in the toner. When the content is too high, the charge quantity of the toner excessively increases, and thereby the electrostatic attraction between the developing roller and the toner increases, resulting in deterioration of fluidity and decrease of image density.

(External Additive)

The toner of the present invention preferably includes a particulate inorganic material as an external additive to improve the fluidity and developing property of the toner. Specific examples of the inorganic material include silicon oxide, zinc oxide, tin oxide, silica sand, titanium oxide, clay, mica, wollastonite, diatom earth, chromium oxide, cerium oxide, red iron oxide, antimony oxide, magnesium oxide, zirconium oxide, barium oxide, barium carbonate, calcium carbonate, silicon carbide, silicon nitride, etc. The added amount of the external additive is from 2.0 to 5.0 parts by weight based on 100 parts by weight of toner particles to which the external additive is added. When the added amount is too large, the background development problem is caused, and the developing property of the toner and the releasability thereof in a fixing process deteriorate. When the added amount is too small, the fluidity, transferability and high temperature preservability of the toner deteriorate.

(Method for Preparing the Toner)

The toner of the present invention is typically prepared by the following method, but is not limited thereto.

(1) a first binder including a hydrocarbon wax, a second binder and a colorant are mixed and kneaded upon application of heat thereto;

(2) after the kneaded mixture is cooled, the mixture is pulverized and then classified to prepare a colored particulate material (i.e., toner particles); and (3) an external additive is added to the toner particles, resulting in formation of the toner of the present invention.

The toner particles preferably have an average particle diameter of from 6 to 10 μm.

The image forming method of the present invention will be explained referring to FIG. 1.

FIG. 1 is a schematic view illustrating an image forming apparatus for use in the image forming method of the present invention.

The image forming apparatus includes a photoreceptor 1 serving as an image bearing member, a charging device 2 configured to charge the photoreceptor 1, a light irradiating device 10 configured to irradiate the charged photoreceptor with image wise light to form an electrostatic latent image on the photoreceptor, four developing devices 11-14 configured to develop the electrostatic latent image with a yellow, magenta, cyan or black color toner, a cleaning device 18 configured to remove residual toner particles remaining on the photoreceptor, a discharging device 19 configured to discharge a residual charge remaining on the photoreceptor even after the toner images are transferred onto the intermediate transfer medium, an intermediate transfer medium 15 configured to receive the color toner images from the photoreceptor, and a transferring device 17 configured to transfer the toner images on the intermediate transfer medium 15 to a receiving material 16.

In the color image forming apparatus illustrated in FIG. 1, different color images (such as yellow, magenta, cyan and black color images) are formed by the four developing devices 11-14 and the color images are overlaid on the intermediate transfer medium 15. The thus overlaid color images are transferred to the receiving material 16 at the same time by the transferring device 17. The thus transferred color images are fixed with a fixing device 20, resulting in formation of a full color image. The image forming order is particularly not limited.

The developing devices 11-14 use the toner of the present invention and includes a developing roller 21 serving as a developer feeding member and a toner layer thickness controlling member 22.

The image forming apparatus is not limited thereto, and four photoreceptors can be used instead of the photoreceptor 1 for forming yellow, magenta, cyan and black color toner images thereon. In addition, the toner images on the photoreceptor can be directly transferred to the receiving material without using the intermediate transfer medium.

A roller having an elastic rubber layer is used as the developing roller 21. An outermost layer which is made of a material capable of being easily charged so as to have a charge with a polarity opposite to that of the toner is formed on the elastic layer. The elastic rubber layer preferably has a JIS-A hardness of not greater than 60° so that the toner pressed at a nip between the toner layer thickness controlling member and the developing roller is prevented from deteriorating. In addition, the surface of the developing roller preferably has a surface roughness Ra (Arithmetical Mean Deviation of the Profile) of from 0.3 to 2.0 μm to bear a desired amount of toner thereon. Further, since a development bias is applied between the developing roller and the photoreceptor, the elastic rubber layer preferably has a resistance of from $10^3$ to $10^{10}\Omega$. The developing roller is rotated while bearing the toner thereon, and thereby the toner is transported to the nip between the developing roller and the toner layer thickness controlling member. The toner layer is transported to the developing gap formed between the developing roller and the photoreceptor.

The toner thickness controlling member is disposed at a position lower than the contact point of the supplying roller and the developing roller. A metal plate spring made of stainless steel or phosphor bronze is used for the toner thickness controlling member. The free end of the toner thickness controlling member is pressed to the surface of the developing roller at a pressure of from 10 to 40 N/m. Therefore, when the toner passes through the nip, a thin layer of the toner is formed while the toner layer is frictionally charged. In addition, in order to assist frictional charging of the toner layer, a bias whose polarity is the same as that of the charge of the toner is applied to the toner layer thickness controlling member.

Specific examples of the materials constituting the elastic rubber layer of the developing roller include styrene-butadiene copolymer rubbers, acrylonitrile-butadiene copolymer rubbers, acrylic rubbers, epichlorohydrin rubbers, urethane rubbers, silicone rubbers, and mixtures of two or more thereof. Among these materials, mixture rubbers of an epichlorohydrin rubber and an acrylonitrile-butadiene copolymer rubber are preferably used. The developing roller for use in the present invention preferably include an electroconductive shaft (made of, for example, a metal such as stainless steel shaft), and an elastic rubber layer located on the surf ace of the shaft. As mentioned above, an outermost layer which is made of a material capable of being easily charged so as to have a charge with a polarity opposite to that of the toner is formed on the elastic layer.

Next, the charging device for charging the image bearing member 1 will be explained.

Figure 2:
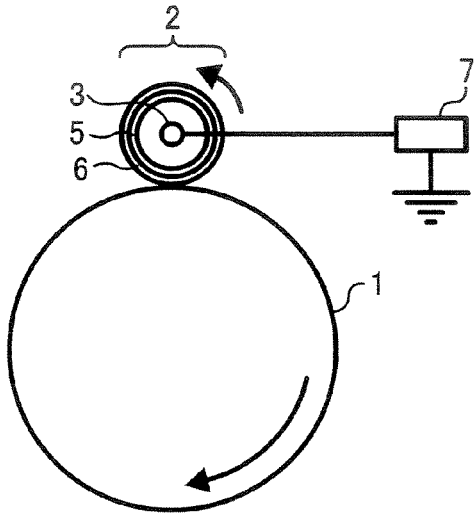
FIG. 2 is a schematic view illustrating the charging device and the photoreceptor of the image forming apparatus illustrated in FIG. 1.

As illustrated in FIG. 2, the charging device includes a charging member 2 having a metal core 3, an electroconductive layer 5 located on the metal core, and an outermost layer 6 located on the electroconductive layer. The charging member typically has a cylindrical form. A voltage applied to the metal core 3 by a power source 7 is applied to an image bearing member 1 (e.g., a photoreceptor) via the electroconductive layer 5 and the outermost layer 6, and thereby the surf ace of the image bearing member 1 is charged.

The metal core 3 of the charging member 2 extends in the longitudinal direction of the image bearing member 1 so as to be parallel to the image bearing member. The charging member 2 is pressed to the image bearing member 1 at a predetermined pressure, and thereby a surface of the image bearing member is contacted with a surface of the charging member 2 in the longitudinal direction thereof, resulting in formation of a nip. The image bearing member 1 is rotated by a driving device (not shown), and thereby the charging member 2 is rotated by the image bearing member 1.

Charging of the image bearing member 1 with the charging member 2 to which a voltage is applied by the power source 7 is performed through the nip and the vicinity of the nip. Since the surface of the charging member 2 is evenly contacted with the surface of the image bearing member, the surface of the image bearing member is uniformly charged.

The electroconductive layer 5 of the charging member 2 is made of a nonmetallic material. In order that the charging member 2 is stably contacted with the image bearing member 1, the nonmetallic material preferably has a low hardness. Specific examples of the nonmetallic material having a low hardness include resins such as polyurethane, polyether, and polyvinyl alcohol; rubbers such as ethylene-propylene-diene-methylene (EPDM), and nitrile-butadiene rubber (NBR). Specific examples of the electroconductive materials to be included in the electroconductive layer 5 include carbon black, graphite, titanium oxide, zinc oxide, etc.

The outermost layer 6 includes a material having a medium resistance of from $10^2$ to $10^{10}\Omega$. Specific examples of the material include resins such as nylon, polyamide, polyimide, polyurethane, polyester, silicone, fluorine-containing resins (e.g., TEFLON (Tradename)), polyacetylene, polypyrrole, polythiophene, polycarbonate, vinyl resins, etc. Among these materials, fluorine-containing resins are preferably used to increase the contact angle of the outermost layer against water. Specific examples of the fluorine-containing resins include polyvinylidene fluoride, polyethylene fluoride, vinylidene fluoride-tetrafluoroethylene copolymers, vinylidene fluoride-tetrafluoroethylene-hexafluoropropylene copolymers, etc. Specific examples of the electroconductive materials to be included in the outermost layer 6 include carbon black, graphite, titanium oxide, zinc oxide, tin oxide, iron oxide, etc.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of the First Binder Resin

The following components were contained in a dropping funnel.

| Vinyl monomers | |
|---|---|
| Styrene | 600 g |
| Butyl acrylate | 110 g |
| Acrylic acid | 30 g |
| Dicumylperoxide (polymerization initiator) | 30 g |

The following components were contained in a four necked 5-liter flask equipped with a thermometer, a stainless stirrer, a condenser, and a nitrogen feed pipe.

| | |
|---|---|
| Monomers for polyester resin | 1230 g |
| Polyoxypropylene(2,2)-2,2-bis(4-hydroxylphenyl) propane | |
| Polyoxyethylene(2,2)-2,2-bis(4-hydroxylphenyl)Propane | 290 g |
| Isododecenyl succinic anhydride | 250 g |
| Terephthalic acid | 310 g |
| 1,2,4-benzenetricarboxylic acid anhydride | 180 g |
| Dibutyl tin oxide (esterification catalyst) | 7 g |
| Paraffin wax | 340 g |
| (melting point: 73.3° C., half width of absorption peak in DSC: 4° C., weight ratio of monomers to wax: 100:11) | |

The components in the four-necked flask were heated to 160° C. by a mantle heater while agitated with the stirrer. In addition, the components in the dropping funnel was dropped in the flask over one hour. After the mixture was heated for 2 hours at 160° C. to complete an addition polymerization reaction, the reaction product was heated to 230° C. to perform a polycondensation reaction. The polymerization degree of the reaction product was occasionally checked using a constant-pressure orifice rheometer. When the reaction product had a desired softening point, the polycondensation reaction was ended. Thus, a resin H1 having a softening point of 130° C. was prepared.

Preparation of Second Binder Resin

The following components were contained in a four necked 5-liter flask equipped with a thermometer, a stainless stirrer, a condenser, and a nitrogen feed pipe.

| | |
|---|---|
| Monomers for polyester resin | 2210 g |
| Polyoxypropylene(2,2)-2,2-bis(4-hydroxylphenyl)propane | |
| Terephthalic acid | 850 g |
| 1,2,4-benzenetricarboxylic acid anhydride | 120 g |
| Dibutyl tin oxide (esterification catalyst) | 0.5 g |

The components in the four-necked flask were heated to 230° C. by a mantle heater while agitated with the stirrer to perform a polycondensation reaction. The polymerization degree of the reaction product was occasionally checked using a constant-pressure orifice rheometer. When the reaction product had a desired softening point, the polycondensation reaction was ended. Thus, a resin L1 having a softening point of 115° C. was prepared.

Preparation of Toner Particles

The following components were mixed with a HENSCHEL MIXER mixer.

| | |
|---|---|
| First binder resin | 70 parts |
| Second binder resin | 30 parts |
| C.I. Pigment Red 57-1 (which is included in a pigment master batch at a P/R ratio of 0.5) | 4 parts |

The mixture was then melted and kneaded with a double-axis kneader PCM-30 from Ikegai Corp. The kneaded mixture was then cooled by a cooling press roller so as to have a thickness of 2 mm, followed by cooling with a cooling belt. After the cooled mixture was crushed with a feather mill, the particles were pulverized with a mechanical pulverizer KTM from Kawasaki Heavy Industries, Ltd. so as to have an average particle diameter of from 10 to 12 μm, followed by pulverization with a jet pulverizer IDS from Nippon Pneumatic Mfg. Co., Ltd. while being subjected to a coarse particle classification. The pulverized mixture was then subjected to a fine particle classification using a rotor classifier TURBOPLEX 100 ATP from Hosokawa Micron Corp. Thus, a colored particulate resin 1 having an average particle diameter of 7.8 μm was prepared.

One hundred (100) parts of the thus prepared colored particulate resin 1 was mixed with each of the particulate inorganic materials as shown in Table 1. In this case, a HENSCHEL MIXER mixer (from Mitsui Miike Machinery Co., Ltd.) was used for mixing. Thus, magenta toners 1-14 were prepared. The treatment conditions are also shown in Table 1.

TABLE 1

| Magenta toner | Added amount of external additive (parts by weight) | | | Treatment condition (HENSCHEL MIXER) | |
|---|---|---|---|---|---|
| | | | | Peripheral speed of tip of rotation blade | Treatment time |
| No. | Silica | Titania | Forsterite | (m/s) | (min) |
| 1 | 3.2 | 0 | 0 | 40 | 2 |
| 2 | 3.0 | 0 | 0 | 40 | 1 |
| 3 | 2.8 | 0.5 | 0 | 40 | 1 |
| 4 | 2.7 | 0 | 0.3 | 40 | 1 |
| 5 | 2.7 | 0.5 | 0 | 35 | 1 |
| 6 | 3.3 | 0.8 | 0 | 40 | 1 |
| 7 | 2.0 | 0 | 0.3 | 40 | 1 |
| 8 | 2.5 | 0 | 0.3 | 40 | 1 |
| 9 | 3.6 | 1.0 | 0 | 40 | 1 |
| 10 | 3.4 | 0.5 | 0 | 40 | 1 |
| 11 | 1.5 | 1.2 | 0.5 | 40 | 1 |
| 12 | 1.0 | 0.5 | 0.1 | 40 | 1 |
| 13 | 1.0 | 0 | 0.5 | 40 | 1 |
| 14 | 0.9 | 0 | 0.7 | 40 | 1 |

Each of the magenta toners 1-14 were evaluated as follows.

1. Particle Diameter Distribution and Average Particle Diameter

The particle diameter distribution, volume average particle diameter (Dv) and number average particle diameter (Dp) of a toner were determined using an instrument such as COULTER COUNTER TA-II or COULTER MULTISIZER (from Beckman Coulter Inc.).

The measurement method is as follows:

(1) 0.1 to 5 ml of a surfactant serving as a dispersant (preferably an aqueous solution of an alkylbenzene sulfonic acid salt) is added to 100 to 150 ml of an electrolyte such as 1% aqueous solution of first class NaCl or ISOTON-II manufactured by Beckman Coulter, Inc.;

(2) 2 to 20 mg of a sample (i.e., a toner) to be measured is added into the mixture;

(3) the mixture is subjected to an ultrasonic dispersion treatment for about 1 to 3 minutes; and (4) the volume average particle diameter distribution and number average particle diameter distribution of the toner are determined using the instrument mentioned above and an aperture of 100 μm.

The weight average particle diameter and number average particle diameter of the toner can be determined from the thus obtained volume and number average particle diameter distributions.

In this case, the particle diameter channels are following 13 channels:

2.00 μm≦C1<2.52 μm; 2.52 μm≦C2<3.17 μm;

3.17 μm≦C3<4.00 μm; 4.00 μm≦C4<5.04 μm;

5.04 μm≦C5<6.35 μm; 6.35 μm≦C6<8.00 μm;

8.00 μm≦C7<10.08 μm; 10.08 μm≦C8<12.70 μm;

12.70 μm≦C9<16.00 μm; 16.00 μm≦C10<20.20 μm;

20.20 μm≦C11<25.40 μm; 25.40 μm≦C12<32.00 μm; and 32.00 μm≦C13<40.30 μm.

Thus, particles having a particle diameter not less than 2.00 μm and less than 40.30 μm are targeted.

2. Shape Factor (i.e., Average Circularity)

The circularity of a particle is defined by the following equation:

$$\text{Circularity}=L_0/L$$

wherein L represents the length of the circumference of the image of a particle and $L_0$ represents the length of the circumference of a circle having the same area as that of the image of the particle.

The average circularity of the toner was determined by a flow-type particle image analyzer, FPIA-1000 manufactured by Sysmex Corp. and an analysis software FPIA-2100 Data Processing Program for FPIA version 00-10.

Specifically, the method is as follows:

(1) in a glass beaker, 0.1 g to 0.5 g of a sample to be measured is mixed with 0.1 ml to 0.5 ml of a dispersant (i.e., a surfactant) such as an alkylbenzene sulfonic acid salt (e.g., NEOGEN SC-A from Dai-ichi Kogyo Seiyaku Co., Ltd.);

(2) after the mixture is dispersed using a micro spatula, 80 ml of ion-exchange water is added thereto;

(3) the mixture is dispersed using an ultrasonic dispersing machine (from Honda Electronics Co., Ltd.) for 3 minutes to prepare a suspension including particles of 5,000 to 15,000 per 1 micro-liter of the dispersion;

(4) the average circularity and circularity distribution of the sample in the suspension are determined by the measuring instrument mentioned above.

In this regard, it is important that the concentration of the dispersion is controlled so as to be from 5,000 to 15,000 per 1 micro-liter. In order to prepare such a dispersion, the added amounts of the dispersant and the toner should be controlled. The added amount of the dispersant should be changed depending on the degree of hydrophobicity of the toner. When the added amount is too large, bubbles are formed in the dispersion and thereby measurements of the average circularity of the toner cannot be well performed. In contrast, when the added amount is too small, the toner cannot be well wet, and thereby the toner cannot be well dispersed. In addition, the added amount of the toner should be changed depending on the average particle diameter of the toner. Specifically, when the toner has a small average particle diameter, the added amount is small. When the toner has a large average particle diameter, the added amount is large. When the average particle diameter of the toner to be measured is from 3 to 7 μm, the added amount of the toner is preferably from 0.1 to 0.5 g. In this case, a dispersion including toner particles at a concentration of from 5,000 to 15,000 per 1 micro-liter can be prepared.

3. Electric Properties

Three (3) grams of a toner was fed into a cell for liquids (i.e., 12964A from Toyo Corp.). While the toner was pressed at a pressure of 7.5N, an AC voltage of 0.1 V was applied thereto. In this regard, the frequency of the AC voltage was changed from 100 Hz to 10000 Hz. Thus, the capacity (C), volume resistivity (R) and dielectric loss tangent (tan δ) of the toner were measured.

4. Image Qualities, etc.

Each of the toners was set in a color laser printer, IPSIO 3000 from Ricoh Co., Ltd., to produce magenta color images. In this regard, images were produced while using each of a contact DC-bias development method, a contact AC-bias development method and a non-contact DC/AC-bias development method. The produced images were evaluated with respect to the following points.

(1) Background Development (in Running Test) (BD-1)

White solid images produced in the running test, in which images are continuously produced, were visually observed to check the whiteness of background of the white solid images.

(2) Background Development (After 12-Hour Pause) (BD-2)

White solid images produced after a 12-hour pause of the printer were visually observed to check the whiteness of background of the white solid images.

(3) Image Density (ID)

The weight of a magenta solid image formed on the photoreceptor was measured.

(4) Toner Consumption (TC)

The weight of the toner in the hopper was checked before and after the running test to determine the amount of the toner used for the running test. The weight of the toner of a solid image was calculated by dividing the amount of the toner by the number of the copies.

The above-mentioned qualities (1)-(4) are graded into the following three ranks:

Rank 3: No problem.

Rank 2: Worse than rank 3 but better than rank 1.

Rank 1: Bad.

The details of Examples 1-7 and Comparative Examples 1-32 are as follows.

Examples 1-5 and Comparative Examples 1-8

Images were produced using each of toners 1-13 and a contact developing method applying a DC development bias of −350V. Each of the toners 1-13 has a volume average particle diameter of 7.8 μm and a circularity of 0.915.

Example 6 and Comparative Examples 9-20

Images were produced using each of toners 1-13 and a contact developing method applying an AC development bias (rectangular wave) having a peak-to-peak voltage of 2 kV and a frequency of 2 kHz. Each of the toners 1-13 has a volume average particle diameter of 7.8 μm and a circularity of 0.915.

Example 7 and Comparative Examples 21-32

Images were produced using each of toners 1-12 and 14 and a non-contact developing method applying a DC bias overlapped with an AC bias (rectangular wave) having a peak-to-peak voltage of 2 kV and a frequency of 2 kHz to the developing sleeve whose surface is apart from the surface of the photoreceptor with a gap of 100 μm. Each of the toners 1-12 and 14 has a volume average particle diameter of 7.8 μm and a circularity of 0.915.

The results are shown in Tables 2 to 4.

TABLE 2

| | | Electric properties | | | Image qualities (Contact DC-bias development) (rank) | | | |
|---|---|---|---|---|---|---|---|---|
| | Magenta toner No. | C (pF) | R (Ω · cm) | tan δ | BD-1 | BD-2 | ID | TC |
| Ex. 1 | 1 | 1.15 | $1.26 \times 10^{11}$ | $1.13 \times 10^{-3}$ | 3 | 3 | 3 | 3 |
| Ex. 2 | 2 | 1.16 | $5.07 \times 10^{10}$ | $2.72 \times 10^{-3}$ | 3 | 3 | 3 | 3 |
| Ex. 3 | 3 | 1.07 | $1.22 \times 10^{11}$ | $1.22 \times 10^{-3}$ | 3 | 3 | 3 | 3 |
| Ex. 4 | 4 | 1.22 | $7.50 \times 10^{10}$ | $1.79 \times 10^{-3}$ | 3 | 3 | 3 | 3 |
| Ex. 5 | 5 | 1.05 | $5.01 \times 10^{10}$ | $3.05 \times 10^{-3}$ | 3 | 3 | 3 | 3 |
| Comp. Ex. 1 | 6 | 0.91 | $1.34 \times 10^{11}$ | $1.32 \times 10^{-3}$ | 1 | 1 | 3 | 1 |
| Comp. Ex. 2 | 7 | 1.29 | $5.40 \times 10^{10}$ | $2.28 \times 10^{-3}$ | 3 | 3 | 1 | 3 |
| Comp. Ex. 3 | 8 | 1.22 | $2.18 \times 10^{10}$ | $6.01 \times 10^{-3}$ | 3 | 1 | 3 | 2 |
| Comp. Ex. 4 | 9 | 0.52 | $3.02 \times 10^{11}$ | $1.00 \times 10^{-3}$ | 1 | 1 | 3 | 1 |
| Comp. Ex. 5 | 10 | 1.06 | $2.40 \times 10^{11}$ | $6.28 \times 10^{-4}$ | 1 | 3 | 3 | 2 |
| Comp. Ex. 6 | 11 | 0.16 | $5.00 \times 10^{10}$ | $2.00 \times 10^{-2}$ | 1 | 1 | 3 | 1 |
| Comp. Ex. 7 | 12 | 1.07 | $7.45 \times 10^{9}$ | $2.10 \times 10^{-2}$ | 1 | 1 | 1 | 1 |
| Comp. Ex. 8 | 13 | 1.34 | $6.03 \times 10^{9}$ | $1.97 \times 10^{-2}$ | 3 | 1 | 1 | 3 |

C: capacitance
R: volume resistivity
tan δ: dielectric loss tangent
BD-1: background development in running test
BD-2: background development after 12-hour pause
ID: image density
TC: toner consumption

TABLE 3

| | | Electric properties | | | Image qualities (Contact AC-bias development) (rank) | | | |
|---|---|---|---|---|---|---|---|---|
| | Magenta toner No. | C (pF) | R (Ω · cm) | tan δ | BD-1 | BD-2 | ID | TC |
| Comp. Ex. 9 | 1 | 1.15 | $1.26 \times 10^{11}$ | $1.13 \times 10^{-3}$ | 3 | 3 | 1 | 3 |
| Comp. Ex. 10 | 2 | 1.16 | $5.07 \times 10^{10}$ | $2.72 \times 10^{-3}$ | 3 | 3 | 1 | 3 |
| Comp. Ex. 11 | 3 | 1.07 | $1.22 \times 10^{11}$ | $1.22 \times 10^{-3}$ | 3 | 3 | 1 | 3 |
| Comp. Ex. 12 | 4 | 1.22 | $7.50 \times 10^{10}$ | $1.79 \times 10^{-3}$ | 3 | 3 | 1 | 3 |
| Comp. Ex. 13 | 5 | 1.05 | $5.01 \times 10^{10}$ | $3.05 \times 10^{-3}$ | 3 | 3 | 1 | 3 |
| Comp. Ex. 14 | 6 | 0.91 | $1.34 \times 10^{11}$ | $1.32 \times 10^{-3}$ | 3 | 3 | 1 | 3 |
| Comp. Ex. 15 | 7 | 1.29 | $5.40 \times 10^{10}$ | $2.28 \times 10^{-3}$ | 3 | 3 | 1 | 3 |
| Comp. Ex. 16 | 8 | 1.22 | $2.18 \times 10^{10}$ | $6.01 \times 10^{-3}$ | 3 | 3 | 1 | 3 |

TABLE 3-continued

| | Magenta toner No. | Electric properties C (pF) | R (Ω · cm) | tan δ | Image qualities (Contact AC-bias development) (rank) BD-1 | BD-2 | ID | TC |
|---|---|---|---|---|---|---|---|---|
| Comp. Ex. 17 | 9 | 0.52 | $3.02 \times 10^{11}$ | $1.00 \times 10^{-3}$ | 3 | 3 | 1 | 3 |
| Comp. Ex. 18 | 10 | 1.06 | $2.40 \times 10^{11}$ | $6.28 \times 10^{-4}$ | 3 | 3 | 1 | 3 |
| Comp. Ex. 19 | 11 | 0.16 | $5.00 \times 10^{10}$ | $2.00 \times 10^{-2}$ | 3 | 3 | 1 | 3 |
| Comp. Ex. 20 | 12 | 1.07 | $7.45 \times 10^{9}$ | $2.10 \times 10^{-2}$ | 3 | 3 | 1 | 3 |
| Ex. 6 | 13 | 1.34 | $6.03 \times 10^{9}$ | $1.97 \times 10^{-2}$ | 3 | 3 | 3 | 3 |

TABLE 4

| | Magenta toner No. | Electric properties C (pF) | R (Ω · cm) | tan δ | Image qualities (Non-contact DC-AC-bias development) (rank) BD-1 | BD-2 | ID | TC |
|---|---|---|---|---|---|---|---|---|
| Comp. Ex. 21 | 1 | 1.15 | $1.26 \times 10^{11}$ | $1.13 \times 10^{-3}$ | 3 | 3 | 1 | 3 |
| Comp. Ex. 22 | 2 | 1.16 | $5.07 \times 10^{10}$ | $2.72 \times 10^{-3}$ | 3 | 3 | 1 | 3 |
| Comp. Ex. 23 | 3 | 1.07 | $1.22 \times 10^{11}$ | $1.22 \times 10^{-3}$ | 3 | 3 | 1 | 3 |
| Comp. Ex. 24 | 4 | 1.22 | $7.50 \times 10^{10}$ | $1.79 \times 10^{-3}$ | 3 | 3 | 1 | 3 |
| Comp. Ex. 25 | 5 | 1.05 | $5.01 \times 10^{10}$ | $3.05 \times 10^{-3}$ | 3 | 3 | 1 | 3 |
| Comp. Ex. 26 | 6 | 0.91 | $1.34 \times 10^{11}$ | $1.32 \times 10^{-3}$ | 3 | 3 | 1 | 3 |
| Comp. Ex. 27 | 7 | 1.29 | $5.40 \times 10^{10}$ | $2.28 \times 10^{-3}$ | 3 | 3 | 1 | 3 |
| Comp. Ex. 28 | 8 | 1.22 | $2.18 \times 10^{10}$ | $6.01 \times 10^{-3}$ | 3 | 3 | 1 | 3 |
| Comp. Ex. 29 | 9 | 0.52 | $3.02 \times 10^{11}$ | $1.00 \times 10^{-3}$ | 3 | 3 | 1 | 3 |
| Comp. Ex. 30 | 10 | 1.06 | $2.40 \times 10^{11}$ | $6.28 \times 10^{-4}$ | 3 | 3 | 1 | 3 |
| Comp. Ex. 31 | 11 | 0.16 | $5.00 \times 10^{10}$ | $2.00 \times 10^{-2}$ | 3 | 3 | 1 | 3 |
| Comp. Ex. 32 | 12 | 1.07 | $7.45 \times 10^{9}$ | $2.10 \times 10^{-2}$ | 3 | 3 | 1 | 3 |
| Ex. 7 | 14 | 1.45 | $5.01 \times 10^{9}$ | $2.18 \times 10^{-2}$ | 3 | 3 | 3 | 3 |

As mentioned above, the developer of the present invention can be uniformly charged efficiently by a developing roller and a toner layer thickness controlling member. Therefore, the toner can produce high quality images without background development when used for electrophotographic copiers and printers.

This document claims priority and contains subject matter related to Japanese Patent Application No. 2006-025178, filed on Feb. 2, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A negatively-chargeable non-magnetic one-component developer for developing an electrostatic latent image using a contact DC-bias development method in which a DC voltage is applied as a development bias, the developer having:

a capacitance of from $1.05\times10^{-12}$ to $1.25\times10^{-12}$ F;

a resistivity of from $5.0\times10^{10}$ to $5.0\times10^{12}$ Ω·cm; and a dielectric loss tangent of from $1.0\times10^{-3}$ to $2.0\times10^{-2}$;

when measured by applying an AC voltage having a voltage of 0.1 V and a frequency of $1.0\times10^{3}$ Hz thereto.

2. The negatively-chargeable non-magnetic one-component developer according to claim 1, wherein the developer has a volume average particle diameter of from 6 to 10 μm and a circularity of from 0.9000 to 0.930.

3. An image forming method comprising developing an electrostatic latent image on an image bearing member with the one-component developer according to claim 1 using a contact DC-bias development method in which a DC voltage is applied as a development bias to form a toner image on the image bearing member;

transferring the toner image onto a receiving material optionally via an intermediate transfer medium; and fixing the toner image on the receiving material.

4. The developer according to claim 1, wherein the developer comprises at least two particulate inorganic materials.

5. The developer according to claim 4, wherein each of the at least two particulate inorganic materials is selected from the group consisting of silica, titania and forsterite.

6. The developer of according to claim 1, wherein:

the binder resin consists of a first binder resin and a second binder resin;

the first binder resin comprises a wax;

the first binder resin is a polyester having an acid value of from 5 to 50 mgKOH/g; and the second binder resin has an acid value of from 0 to 10 mgKOH/g.

7. The developer according to claim 6, wherein the first binder resin has an acid value of from 10 to 40 mgKOH/g.

8. The developer according to claim 6, wherein the second binder resin has an acid value of from 1 to 5 mgKOH/g.

9. A negatively-chargeable non-magnetic one-component developer for developing an electrostatic latent image using a contact AC-bias development method in which an AC voltage is applied as a development bias, the developer having:

a capacitance of from $1.30\times10^{-12}$ to $1.60\times10^{-12}$ F;

a resistivity of from $5.0\times10^{9}$ to $5.0\times10^{10}$ Ω·cm; and a dielectric loss tangent of from $1.0\times10^{-3}$ to $2.0\times10^{-2}$;

when measured by applying an AC voltage having a voltage of 0.1 V and a frequency of $1.0\times10^{3}$ Hz thereto.

10. The negatively-chargeable non-magnetic one-component developer according to claim 9, wherein the developer has a volume average particle diameter of from 6 to 10 μm and a circularity of from 0.9000 to 0.930.

11. An image forming method comprising developing an electrostatic latent image on an image bearing member with the one-component developer according to claim 9 using a contact AC-bias development method in which an AC voltage is applied as a development bias to form a toner image on the image bearing member;

transferring the toner image onto a receiving material optionally via an intermediate transfer medium; and fixing the toner image on the receiving material.

12. The developer according to claim 9, wherein the developer comprises at least two particulate inorganic materials.

13. The developer according to claim 12, wherein each of the at least two particulate inorganic materials is selected from the group consisting of silica, titania and forsterite.

14. The developer of according to claim 9, wherein:

the binder resin consists of a first binder resin and a second binder resin;

the first binder resin comprises a wax;

the first binder resin is a polyester having an acid value of from 5 to 50 mgKOH/g; and the second binder resin has an acid value of from 0 to 10 mgKOH/g.

15. A negatively-chargeable non-magnetic one-component developer for developing an electrostatic latent image using a non-contact DC/AC-bias development method in which a DC voltage overlapped with an AC voltage is applied as a development bias the developer having:

a capacitance of from $1.45\times10^{-12}$ to $1.60\times10^{-12}$ F;

a resistivity of from $5.0\times10^{9}$ to $1.0\times10^{10}$ Ω·cm; and a dielectric loss tangent of from $1.0\times10^{-3}$ to $2.0\times10^{-2}$;

when measured by applying an AC voltage having a voltage of 0.1 V and a frequency of $1.0\times10^{3}$ Hz thereto.

16. The negatively-chargeable non-magnetic one-component developer according to claim 15, wherein the toner has a volume average particle diameter of from 6 to 10 μm and a circularity of from 0.9000 to 0.930.

17. An image forming method comprising developing an electrostatic latent image on an image bearing member with the one-component developer according to claim 15 using a non-contact DC/AC-bias development method in which a DC voltage overlapped with an AC voltage is applied as a development bias to form a toner image on the image bearing member;

transferring the toner image onto a receiving material optionally via an intermediate transfer medium; and fixing the toner image on the receiving material.

18. The developer according to claim 15, wherein the developer comprises at least two particulate inorganic materials.

19. The developer according to claim 18, wherein each of the at least two particulate inorganic materials is selected from the group consisting of silica, titania and forsterite.

20. The developer of according to claim 15, wherein:

the binder resin consists of a first binder resin and a second binder resin;

the first binder resin comprises a wax;

the first binder resin is a polyester having an acid value of from 5 to 50 mgKOH/g; and the second binder resin has an acid value of from 0 to 10 mgKOH/g.

* * * * *